US008082894B2

(12) United States Patent
Pöschl et al.

(10) Patent No.: US 8,082,894 B2
(45) Date of Patent: Dec. 27, 2011

(54) CYLINDER HEAD HAVING COOLANT FLOW GUIDE DEVICE

(75) Inventors: Robert Pöschl, Graz-Andritz (AT); Alexander Maier, Hetzendorf (AT)

(73) Assignee: AVL List GmbH, Graz (AT)

( * ) Notice: Subject to any disclaimer, the term of this patent is extended or adjusted under 35 U.S.C. 154(b) by 835 days.

(21) Appl. No.: 12/084,404

(22) PCT Filed: Oct. 19, 2006

(86) PCT No.: PCT/AT2006/000427

§ 371 (c)(1),
(2), (4) Date: Apr. 30, 2008

(87) PCT Pub. No.: WO2007/051212

PCT Pub. Date: May 10, 2007

(65) Prior Publication Data

US 2009/0255490 A1 Oct. 15, 2009

(30) Foreign Application Priority Data

Nov. 4, 2005 (AT) ..... A 1803/2005
Dec. 1, 2005 (AT) ..... A 1944/2005

(51) Int. Cl.
*F02F 1/40* (2006.01)

(52) U.S. Cl. ..... 123/41.82 R; 123/41.85; 123/193.5

(58) Field of Classification Search ..... 123/41.82 R, 123/41.85
See application file for complete search history.

(56) References Cited

U.S. PATENT DOCUMENTS 4,515,111 A * 5/1985 Vosmeyer et al. ..... 123/41.61
4,569,313 A * 2/1986 Nobu ..... 123/41.74
5,076,217 A * 12/1991 Clough ..... 123/41.74
5,379,729 A * 1/1995 Yonezwa et al. ..... 123/41.82 R
5,836,272 A * 11/1998 Sakurai ..... 123/41.82 R
5,868,106 A * 2/1999 Poropatic et al. ..... 123/41.82 R
6,681,727 B2 * 1/2004 Krenn ..... 123/41.82 R

FOREIGN PATENT DOCUMENTS

| | | |
|---|---|---|
| EP | 1239135 | 9/2002 |
| GB | 583 652 | 12/1946 |
| JP | 2000-310157 | 7/2000 |
| WO | 2005042955 | 5/2005 |

OTHER PUBLICATIONS

English Abstract of JP 2000-310157.

* cited by examiner

*Primary Examiner* — Michael Cuff
*Assistant Examiner* — Grant Moubry
(74) *Attorney, Agent, or Firm* — Dykema Gossett PLLC

(57) ABSTRACT

The invention relates to a cylinder head (1) for a liquid-cooled internal combustion engine with several cylinders, comprising at least one intake port (5) and at least two exhaust ports (4) per cylinder (1), at least one first cooling chamber (2) adjacent to a fire deck and at least one second cooling chamber (3) adjacent to the first cooling chamber (2), with the second cooling chamber (3) extending over several cylinders. In order to improve cooling in the areas subjected to great thermal stress it is provided that at least one first cooling chamber (2) is provided per cylinder and the first cooling chambers (2) of two adjacent cylinders are separated from one another, with each first cooling chamber (2) comprising at least one first opening (7) and at least one transfer opening (8) to the second cooling chamber (3), and the first cooling chamber (2) is flowed through between the first opening (7) and the transfer opening (8) substantially in the longitudinal direction of the cylinder head (1).

9 Claims, 4 Drawing Sheets

CYLINDER HEAD HAVING COOLANT FLOW GUIDE DEVICE

BACKGROUND OF THE INVENTION

1. Field of the Invention

The invention relates to a cylinder head for a liquid-cooled internal combustion engine with several cylinders, comprising at least one intake port and at least two exhaust ports per cylinder, at least one first cooling chamber adjacent to a fire deck and at least one second cooling chamber adjacent to the first cooling chamber, with the second cooling chamber extending over several cylinders. The invention further relates to a cylinder head for several cylinders, comprising an intake side with at least one intake valve and at least one intake valve seat per cylinder and an exhaust side with at least two exhaust valves and at least two exhaust valve seats per cylinder, a parallel or twisted valve image, a central cooling chamber which is flowed through substantially in the longitudinal direction of the cylinder head, with a cooling duct being provided in the area of the exhaust valve bridge between the exhaust valve seats.

2. The Prior Art

A cylinder head for a liquid-cooled internal combustion engine with several cylinders is known from WO 2005/042955 A2, which cylinder head comprises a first cooling chamber adjacent to a fire deck and a second cooling chamber adjacent to the first cooling chamber, with first and second cooling chamber being flow-connected with each other through at least one transfer opening per cylinder. The first cooling chamber can be connected via at least a first opening with a cooling jacket of the cylinder housing. The second cooling chamber comprises a second opening on at least one face side. In order to improve cooling in thermally highly loaded regions, at least a first opening and at least a transfer opening are arranged in the region of a transversal engine plane which is arranged normally to the crankshaft between two adjacent cylinders, with a longitudinal wall being arranged in the first cooling chamber in the area between two exhaust port openings of adjacent cylinders and a coolant duct between the exhaust ports in the area of the exhaust port openings of a cylinder each. The first cooling chamber is arranged continuously for all cylinders.

Two different flow concepts are known in the case of liquid-cooled cylinder heads. In the case of longitudinal flow concepts, the cylinder head is flowed through substantially in the longitudinal direction from one cylinder to the next one. This allows optimal cooling of the valve bridges along the internal combustion engine. It is disadvantageous that relatively high pressure losses will accumulate and that the temperature of the coolant will rise successively from the first to the last cylinder.

Cylinder heads with cross-flow concepts comprise one coolant inlet and one coolant outlet per cylinder, so that each cooling chamber can be flowed through by coolant in the transversal direction to the longitudinal axis of the engine. The cooling chambers of the cylinders are flowed through in parallel here, so that only low pressure losses will occur. The same applies to the valve bridges along the engine. The coolant flow will split up here between the outlet ducts into usually two parts, as a result of which the flow rates are limited. A further advantage is that the inflow temperature of the coolant is the same for all cylinders. Cylinder heads with cross-flow cooling must be equipped with a coolant collector.

A parallel valve image means in this connection that the axes of the intake and/or exhaust ports will open up planes which are arranged parallel to the longitudinal axis of the cylinder head. In contrast to this, the planes opened up by the axes of the respective valves are arranged inclined to the longitudinal axis of the cylinder head in the case of a twisted valve image.

In the case of cylinder heads with cooling chambers which are scavenged longitudinally, the problem may occasionally occur that thermally highly loaded regions which are oriented transversally to the direction of the engine, especially between the valve seats of the exhaust ports in a parallel valve image, can be cooled only insufficiently due to lack of a pressure difference that drives the flow. This may lead to material failure induced for thermal reasons.

It is the object of the invention to avoid these disadvantages and to improve the cooling in a cylinder head of the kind mentioned above. It is a further object of the invention to improve the evenness of cooling between all valve bridges. Flow losses should be kept as low as possible in combination with optimal cooling effect.

SUMMARY OF THE INVENTION

This is achieved in accordance with the invention in such a way that at least one first cooling chamber is provided per cylinder and the first cooling chambers of two adjacent cylinders are separated from one another, with the first cooling chamber comprising at least one first opening and at least one transfer opening to the second cooling chamber, and the first cooling chamber is flowed through between the first opening and the transfer opening substantially in the longitudinal direction of the cylinder head.

Since the first cooling chambers are flowed through in parallel, the inflow temperatures of the coolant are identical for all cylinders and only low pressure losses occur. A local longitudinal flow is formed however per cylinder in each first cooling chamber. This is achieved in such a way that the first opening and the transfer opening are spaced from one another in the direction of the longitudinal axis of the cylinder head. It is preferably provided that the first opening and transfer opening of the first cooling chamber, when seen in a plan view, are arranged diametrical with respect to one another with respect to the exhaust valve seats.

The valve bridges along the cylinder head can be cooled optimally through the local longitudinal flow of the first cooling chambers.

It is especially advantageous when a guide rib is arranged in the first cooling chamber between the first opening and a cooling passage in the area of the exhaust valve bridge, which guide rib obstructs the direct through-flow between the first opening and the cooling passage in the area of the exhaust valve bridge. The guide ribs ensure that the local longitudinal flow is superimposed with a cross-flow component, so that the valve bridges between the two exhaust valve seats can be cooled in an optimal way. A fine adjustment can be achieved in such a way that the guide rib comprises a bypass opening which enables a defined through-flow between the inlet and the cooling passage in the area of the exhaust valve bridge.

It is further possible that at least two first openings open into the first cooling chamber, with preferably the two first openings being arranged on either side of the guide rib.

The longitudinal flow about the thermally highly loaded valve bridges is preferably limited to only one cylinder. In the case of multi-cylinder internal combustion engines with at least four cylinders, e.g. with six or eight cylinders, and/or in the case of compact V-engines with a very small valve angle, a combination of two cylinders each in a first cooling chamber is advantageous for cost and production reasons (core stiffness).

The second cooling chamber comprises cooling areas beneath the intake ports and above the exhaust ports, which cooling areas are loaded to a low extent. In order to sufficiently cool highly loaded areas it is advantageous when the first cooling chamber comprises cooling passages beneath the exhaust ports and in the area of the valve bridges between the exhaust valve seats.

The second cooling chamber is used as a collecting chamber for the coolant flowing from the first cooling chambers. It is preferably provided here that the height of the second cooling chamber corresponds at least to the eight of the first cooling chamber, with preferably the second cooling chamber being one to four times as high as the first cooling chamber.

In order to achieve an even cooling between all valve bridges it is provided that a guide device for deflecting the longitudinal coolant flow is provided in the cooling duct between the two exhaust valve seats for each cylinder in the area of at least one exhaust valve seat. It is preferably provided that the guide device is formed by a transverse rib preferably arranged parallel to a transverse plane of the cylinder head.

The guide device preferably extends over the entire height of the flow passage close to the fire deck beneath the exhaust port. The guide device is used to redirect the coolant flow which flows along the cylinder head between the exhaust valves, the fire deck and the outside wall of the cylinder head into a cooling duct oriented transversally to the cylinder head via the exhaust valve bridge between the two exhaust valve seats. As a result, the flow and cooling situation of the thermally highly loaded area is set around the exhaust valve seats between the two exhaust valves.

It is preferably provided that the guide device comprises at least one bypass opening. In order to achieve a sufficient redirection of the coolant flow into the cooling duct between the two exhaust valves, the flow cross section of the bypass openings or the sum total of the flow cross sections of the bypass openings should be smaller than the flow cross section of the cooling duct. It can alternatively also be provided that at least one secondary intake opening which can be connected with the cooling jacket of the cylinder block opens into the cooling chamber per cylinder. This helps in preventing the production of a dead water zone.

In a preferred embodiment it is provided that the guide device, relating to the coolant flow along the cylinder head, is arranged in the area of the downstream exhaust valve, with the coolant flow being joined in the area of the central cooling duct at the injector. As an alternative it may also be provided that the guide device, when seen with regard to the flow direction of the coolant flow, is arranged in the area of the upstream exhaust valve, with the coolant flow being split at the injector in the area of the coolant duct between exhaust and intake valves.

In order to ensure sufficient cooling of the thermally highly loaded areas it is necessary that the guide device is arranged between an exhaust port, the fire deck and the side wall of the cylinder head.

In order to achieve even cooling of all cylinders, it can be provided in a further development of the invention that at least one secondary inlet opening for the coolant is arranged per cylinder, with preferably the maximum height of the central cooling chamber increasing in the areas of each cylinder in the direction of flow of the cooling medium along the cylinder head. As a result of precisely defined shaping of the cooling chamber ceiling of the central cooling chamber, cooling of the individual cylinders can be adjusted to the requirements. It is especially possible to compensate a decreasing cooling effect due to the temperature rising from cylinder to cylinder and the decreasing pressure level of the coolant by purposeful shaping of the cross section and thus adjusted local flow rate of the central cooling chamber.

The invention is now explained in greater detail below by reference to the drawings.

BRIEF DESCRIPTION OF THE DRAWINGS

FIGS. 1 to 5 show the coolant-filled chambers of a cylinder head 1. Cylinder head 1 comprises a first cooling chamber 2 on the exhaust side and a second cooling chamber 3 on the intake side. Intake ports opening into the combustion chamber are designated with reference numeral 5. The exhaust ports are designated with reference numeral 4.

Figure 1:
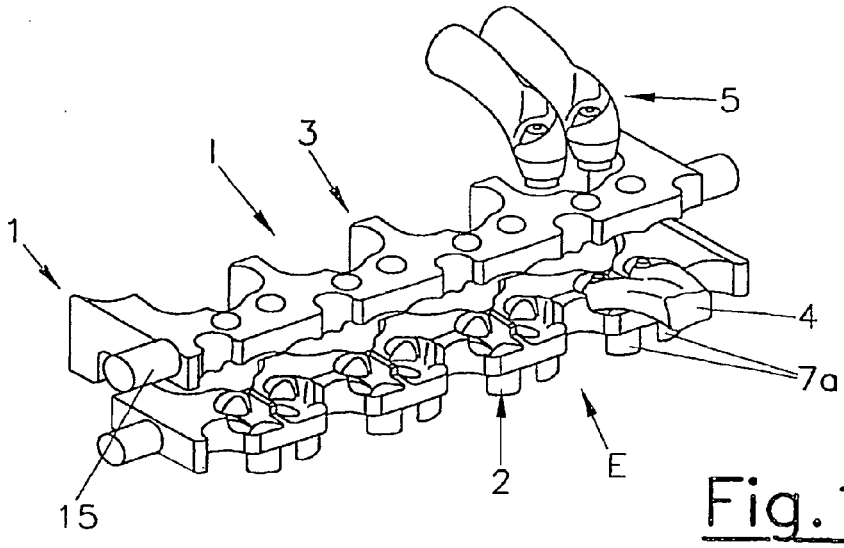
FIG. 1 shows the cooling chambers of a cylinder head in accordance with the invention in an oblique view.

Reference numeral I designates the intake side, and reference numeral E the exhaust side of the cylinder head 1.

The first cooling chamber 2 is connected via several first inlet openings 7 in the fire deck 6 of the cylinder head 1 with a cooling jacket (not shown in greater detail) of the cylinder block. The first cooling chamber 2 is flow-connected with the second cooling chamber 3 via transfer openings 8 in the cylinder head 1. The transfer openings 8 are formed by bores extending substantially parallel to the cylinder axis. Reference numeral 9 designates the areas of the exhaust valve seats of exhaust valves which are not shown in greater detail.

The first and second cooling chambers 2, 3 are separated from one another in the area of the transverse plane of the engine by an intermediate wall 12 extending substantially in the longitudinal direction of the cylinder head 1.

Figure 2:
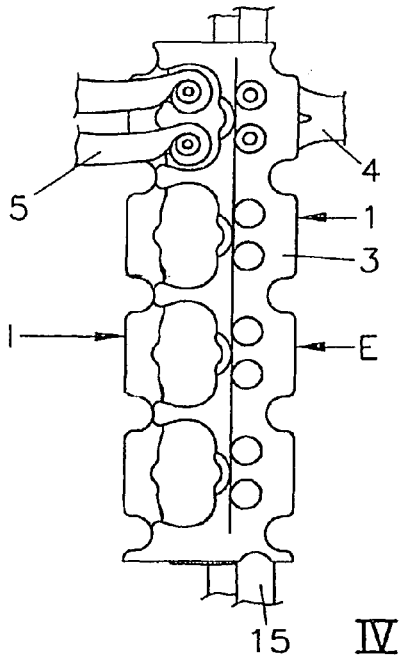
FIG. 2 shows a top view of the cooling chambers.
Figure 3:
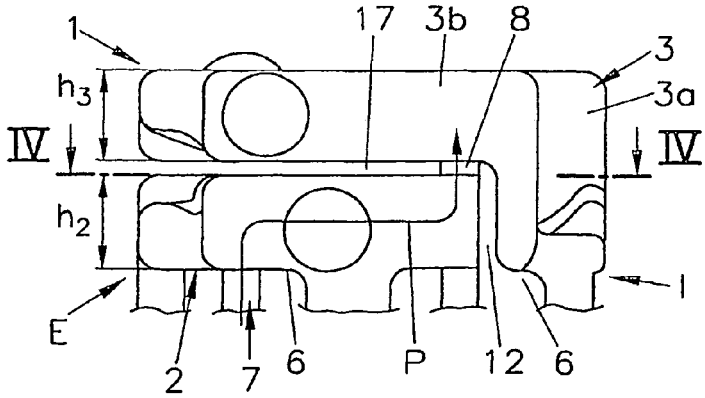
FIG. 3 shows a side view of the cooling chambers.

As is shown in FIG. 2, the second cooling chamber 3 on the intake side I is arranged substantially above the first cooling chamber 2. The second cooling chamber 3 has a substantially "L"-shaped cross section, with the shorter leg 3*a* being arranged on the intake side I and extending on this side up to the fire deck 6. Intermediate wall 12 is arranged between the first cooling chamber 2 and the shorter leg 3*a* of the second cooling chamber 3. The longer leg 3*b* of the second cooling chamber 3 is separated from the first cooling chamber 2 by an intermediate deck 17. The heights $h_2$, $h_3$ of the first and second cooling chambers 2, 3 are arranged approximately the same in the embodiment. The height $h_3$ of the second cooling chamber 3 can be up to four times the height $h_2$ of the first cooling chamber 2.

Figure 4:
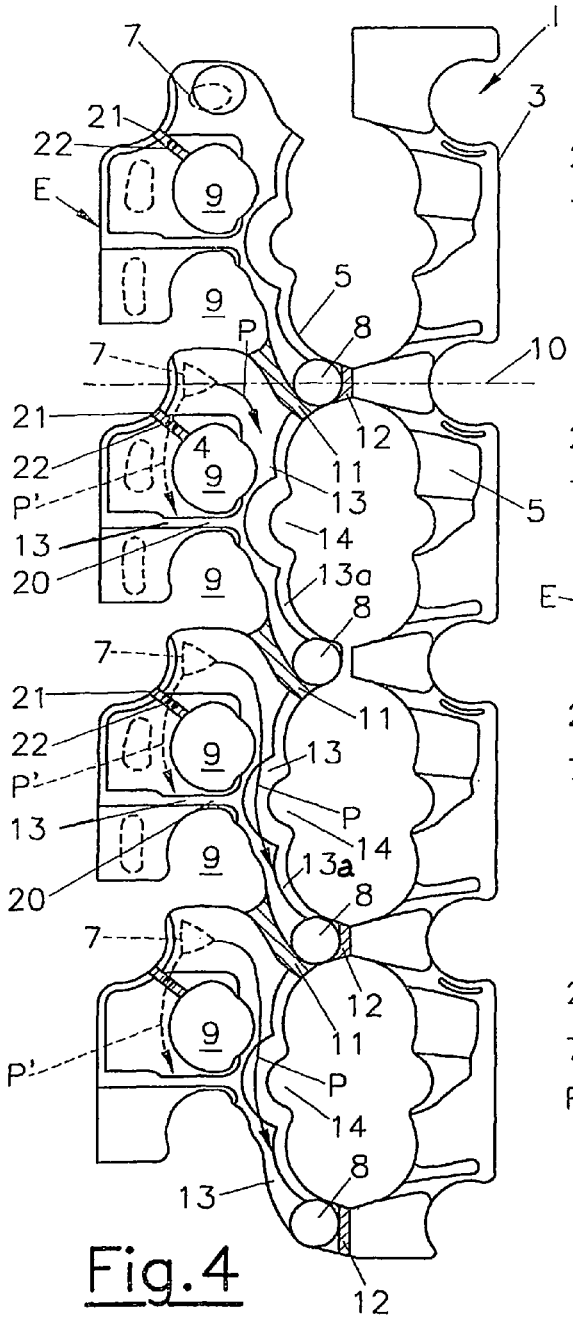
FIG. 4 shows the cooling chambers in a sectional view along line IV-IV in FIG. 3 in a first embodiment.

The first cooling chambers 2 of two adjacent cylinders are separated from each other by a separating wall 11 in the area of the transverse plane 10 of the engine between two cylinders. A first opening 7 opens into the first cooling chamber 2 for each cylinder. Every first cooling chamber 2 is connected via a transfer opening 8 each with the second cooling chamber 3. First opening 7 and transfer opening 8 are spaced from one another as far as possible in the longitudinal direction of the cylinder head 1, with the first opening 7 being arranged adjacent to an exhaust valve seat 9 and the transfer opening 8 adjacent to the intake port 5 in the area of the transverse plane 10 of the engine. The first opening 7 is also positioned in the area of the transverse plane 10 of the engine. As a result of the separating wall 11 arranged between first opening 7 and transfer opening 8, the coolant is prevented from flowing in the shortest possible way through the next transfer opening 8 into the second cooling chamber 3. The coolant which enters the first cooling chamber 2 through the first opening 7 is rather redirected in the longitudinal direction of the cylinder head 1. The coolant thus reaches the first cooling chamber 2 of the cylinder head 1 via the first openings 7 from the cooling jacket of the cylinder housing (not shown in greater detail) and flow according to the arrows P as shown in the FIGS. 4 and 5 along the separating wall 11, flows about the exhaust port 4 and reaches the area of the cylinder center 14 through the coolant duct 13 via the hot valve bridges between the intake valve seats and the exhaust valve seats 9. The coolant flows further via the cooling passage 13*a* to the transfer opening 8 and into the second cooling chamber 3 situated above the same. The coolant leaves the same via a second opening 15.

A guide rib 21 is arranged on the outer side of the first cooling chamber 2 between the first opening 7 and the area of the exhaust valve bridge 20 between the two exhaust valve seats 9, which rib at least obstructs the through-flow in the area of the exhaust valve bridge 20. The guide rib 21 may comprise a bypass opening 22 for a low, precisely defined quantity of coolant. The defined coolant flow P' can flow through said bypassing openings 22 to a cooling passage 13*a* in the area of the hot exhaust valve bridge 20 between the exhaust valve seats 9, as is indicated with arrow P'. The hot exhaust valve bridge 20 is thus cooled.

Figure 5:
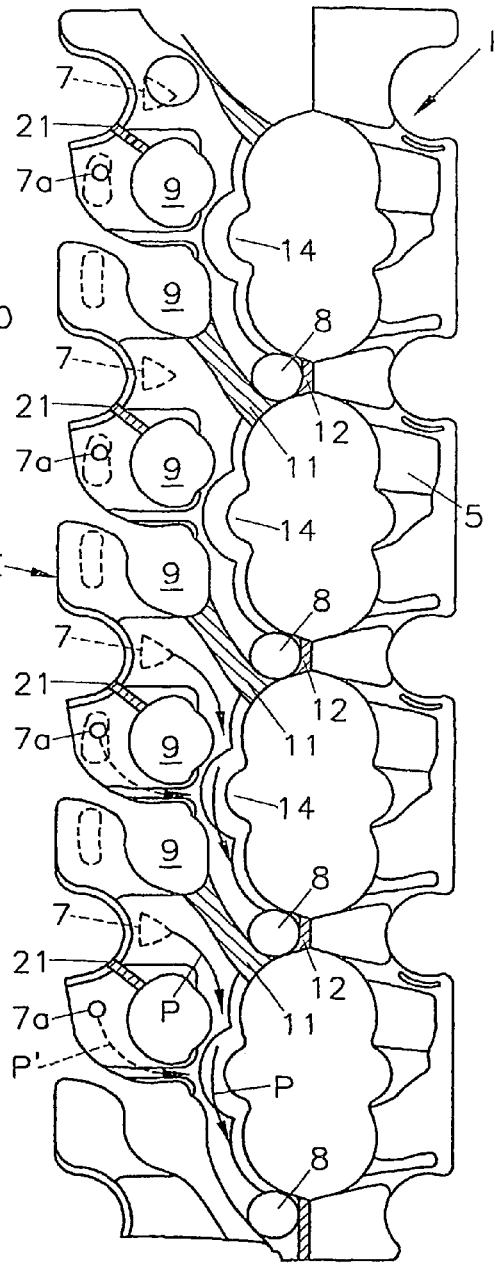
FIG. 5 shows the cooling chambers in a sectional view in analogy to FIG. 4 in a second embodiment.
Figure 6:
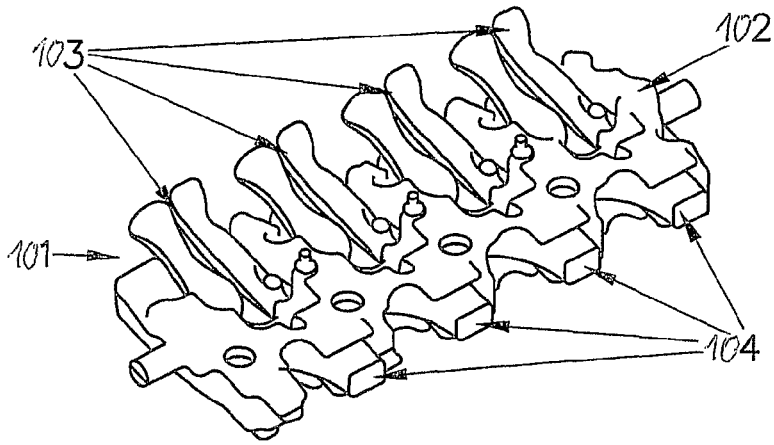
FIG. 6 shows a core view of the cylinder head in accordance with the invention in an oblique view.
Figure 7:
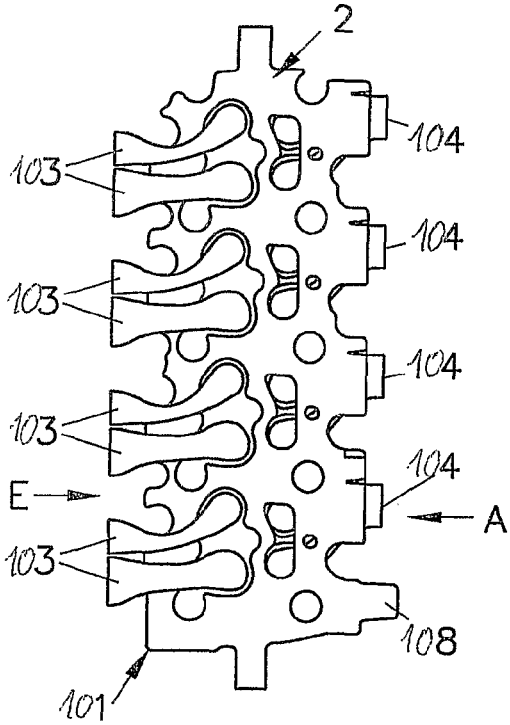
FIG. 7 shows a top view of the core arrangement of the cylinder head.
Figure 8:
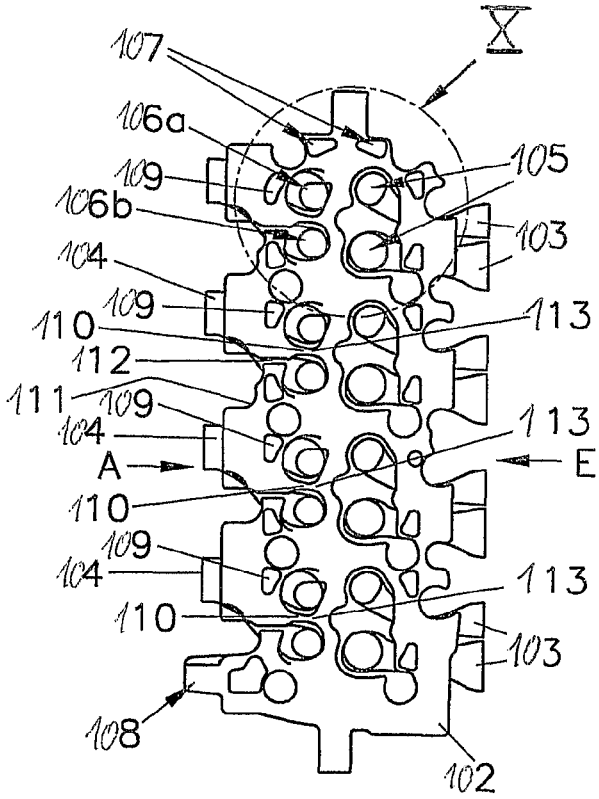
FIG. 8 shows a view from below of the core structure.

Instead of or in addition to the bypass opening 22, a further first opening 7*a* can also be provided for coolant entering the first cooling chamber 2, as shown in the embodiment as shown in FIG. 5. The coolant flows via the further first opening 7*a* and the cooling passage 13*a* over the thermally critical area of the exhaust valve bridge 20 between the exhaust valve seats 9.

The coolant thus enters the first cooling chamber 2 on the exhaust side and is then directly guided to the most critical cooling area between the exhaust ports 4 to the cooling passages 13 and 13*a* which are susceptible to fissures as a result of the obstruction to extension in the longitudinal direction of the engine and to the area of a centrally arranged injector, thus enabling optimal dissipation of heat from the hottest areas of the cylinder head 1.

A further advantage of the cooling chamber arrangement is that during casting production the casting cores for the exhaust ports 4 can be inserted from above, like the casting cores for the intake ports 5. As is shown in FIG. 1, at first the core for the first cooling chamber 2, then the cores for the exhaust ports 4 and then the core for the second cooling chamber 3 and finally the cores for the intake ports 4 are inserted into the core box (not shown in greater detail).

The invention is demonstrated best on the basis of core structures 101 for the cooling chambers 102, intake ports 103 and exhaust ports 104.

The cylinder head comprises a longitudinally scavenged cooling chamber 102 which extends over several cylinders. The intake side of the cylinder head is designated with E and the exhaust side with A. The cylinder head comprises for each cylinder two intake valve seats 105 and two exhaust valve seats 106*a*, 106*b* interrupting the core structure. The coolant reaches via the main inlet openings 107 to a rear face side of the cylinder head in the cooling chamber 102, flows through the cylinder head in the longitudinal direction and leaves the cooling chamber 102 again via a main outlet opening 108 in the region of the front face side. At least one secondary inlet opening 109 is further provided for each cylinder, through which additional coolant reaches the cooling chamber 102.

Figure 9:
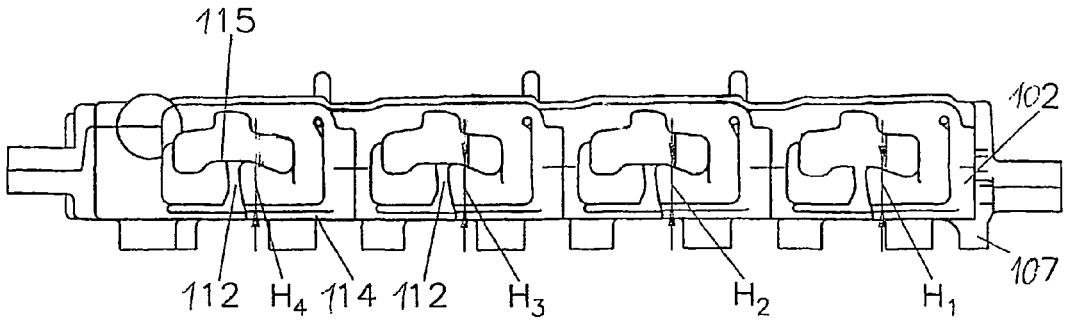
FIG. 9 shows the core view of a view on the exhaust side.

In order to enable sufficient cooling of the thermally critical area of the exhaust valve bridges 110 between two exhaust valve seats 106*a*, 106*b* each, a guide device is provided between an exhaust valve seat 106*a*, 106*b* and the cylinder head side wall 111, which guide device is formed by a transverse rib 112 and through which the coolant is redirected by a cooling duct 113 via the exhaust valve bridge 110 between the two exhaust valve seats 106*a*, 106*b* in the direction of the center of the cylinder. The transverse rib 112 extends between the fire deck 114 and the cooling chamber ceiling 115 of the central cooling chamber 102, as shown in FIG. 9. The path of the coolant flow is indicated with arrows $S_1$, $S_1'$, $S_1''$ in FIG. 10.

A bypass opening 116 can be arranged in the transverse rib 112 in order to enable a precisely defined quantity of coolant to pass the transverse rib 112 along the cylinder head. Non-cooled dead water zones on the exhaust valve seat 106 behind the transverse rib 112 are thus avoided. The cross section of the bypass opening 116 is smaller than the cross section of the cooling duct 113 between the two exhaust valve seats 106.

The transverse rib 112 produces a pressure difference in the cooling chamber 102 transversally to the cylinder head, as a result of which the flow conditions at the thermally critical points in the area of the exhaust valve bridge 110 (indicated in FIG. 10 with reference numeral CR1) and thermally critical regions between the exhaust valve seats 106*a*, 106*b*, intake valve seats 105 and injector (indicated in FIG. 10 with reference numeral CR2) can be better adjusted.

In order to ensure an even cooling of all cylinders, additional coolant is supplied per cylinder via the secondary inlet openings 109. In order to achieve an adjustment of the flow rate close to the fire deck within the cylinders and over the entire cylinder head, the maximum height $H_1$, $H_2$, $H_3$, $H_4$ when seen in the direction of flow of the coolant will increase per cylinder. Pressure losses can thus be kept as low as possible and optimal even cooling in all areas of the cooling chamber 102 can be reached.

Figure 10:
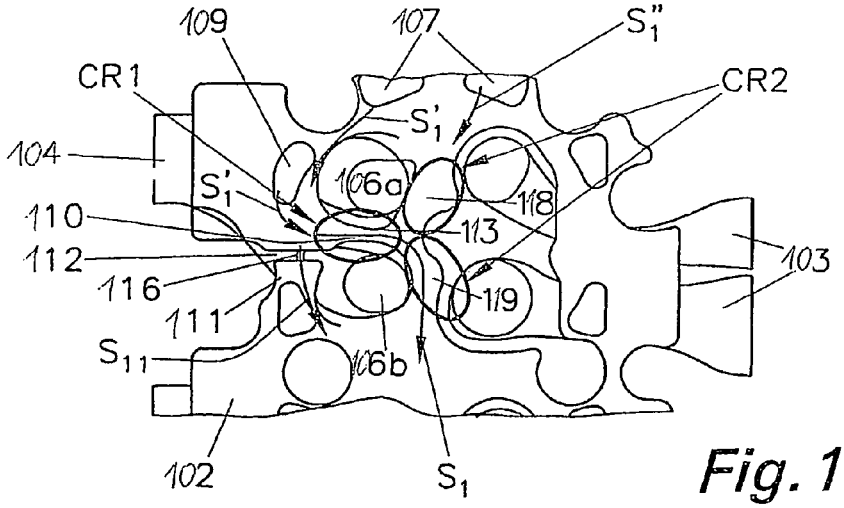
FIG. 10 shows the detail X of FIG. 8.

In the embodiment as shown in FIG. 10, the outer coolant flow $S_1'$ in the area of the exhaust valve bridge 110 is combined at the injector as a result of transverse rib 112 with the inner coolant flow $S_1''$ from the upstream valve bridge 118 into a common main coolant flow $S_1$, because the transverse rib 112, when seen in the direction of flow of the coolant, is arranged between the downstream exhaust valve seat 106*a* and the cylinder head side wall 111. In the area of the valve bridge 110, the flow $S_{11}$ splits off from the outer coolant flow $S_1'$ through the bypass opening 116.

Figure 11:
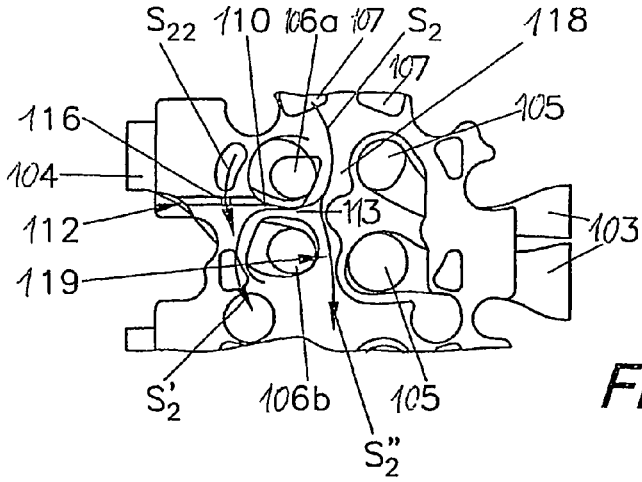
FIG. 11 shows a core structure of the cylinder head in accordance with the invention in a further embodiment in a detailed view in analogy to FIG. 10.

FIG. 11 shows an alternative embodiment in which the transverse rib 112 is arranged between the upstream exhaust valve seat 106*a* and the cylinder head wall 111. This leads to the consequence that an outer coolant flow $S_2'$ will flow through the coolant duct 113 via the exhaust valve bridge 110 between the two exhaust valve seats 106*a*, 106*b* according to arrow $S_2'$ to the outside from the upstream valve bridge 118 from the main flow $S_2$ in the area of the cylinder center. In the area of the downstream exhaust valve seat 106*b*, the outer coolant flow $S_2'$ through the coolant duct 113 will combine with the flow $S_{22}$ through the bypass opening 116. This embodiment is especially suitable for constructions in which the upstream valve bridge 118 between intake valve 105 and exhaust valve seat 106*a* is larger than the downstream valve bridge 119. The embodiment according to FIG. 10 on the other hand is suitable for applications in which the upstream valve bridge 118 is smaller than the downstream valve bridge 119.

The area between the valve seats 106*a*, 106*b* of the exhaust valves can be cooled optimally by the transverse rib 112 in any embodiment of the invention.

The invention claimed is:

1. A cylinder head for several cylinders, comprising:

an intake side with at least one intake valve with at least one intake valve seat per cylinder and an exhaust side with at least two exhaust valves:

at least two exhaust valve seats per cylinder;

a parallel or twisted valve image;

a central cooling chamber which is flowed through substantially in a longitudinal direction of the cylinder head, with a cooling duct being provided in an area of an exhaust valve bridge between the exhaust valves;

wherein a guide device for deflecting the longitudinal coolant flow extends in a substantially transverse direction of the cylinder head from a wall of a first exhaust valve seat at an area adjacent a second exhaust valve seat to a side wall of the cylinder head for each cylinder, the guide device being provided between an exhaust port and a fire deck of the cylinder head.

2. The cylinder head according to claim 1, wherein the guide device is formed by a transverse rib arranged parallel to a transverse plane of the cylinder head.

3. The cylinder head according to claim 1, wherein the guide device extends over the entire height of the cooling chamber between the exhaust port and the fire deck.

4. The cylinder head according to claim 1, wherein the guide device comprises at least one bypass opening.

5. The cylinder head according to claim 4, wherein the cross section of the bypass opening or the sum total of the cross sections of all bypass openings is smaller than the cross section of the cooling duct between the two exhaust ports.

6. The cylinder head according to claim 1, wherein at least one secondary inlet opening for coolant is arranged per cylinder.

7. The cylinder head according to claim 1, wherein the guide device, relating to direction of flow main coolant flow, is arranged in the area of a downstream exhaust valve seat and at least partly blocks a flow path between the downstream exhaust valve seat and the side wall of the cylinder head, with the coolant flows enclosing the upstream exhaust valve seat being combined in the area of the cooling duct between the exhaust valve seats into the main coolant flow.

8. The cylinder head according to claim 1, wherein the guide device, relating to the direction of flow of the main coolant flow, is arranged in the area of the upstream exhaust valve seat and at least partly blocks a flow path between the upstream exhaust valve seat and the side wall of the cylinder head, with the main coolant flow being divided into coolant flows guided about the downstream exhaust valve in the area of the cooling duct between the exhaust valve seats.

9. The cylinder head according to claim 1, wherein the maximum height of the cooling chamber increases in the area of each cylinder in the direction of flow of the cooling medium along the cylinder head.

* * * * *